United States Patent [19]

Flinois

[11] Patent Number: 4,982,182

[45] Date of Patent: Jan. 1, 1991

[54] DIRECTLY DRIVEN LIGHT EMITTING DIODE ARRAY

[75] Inventor: Jean Flinois, Brinon-sur-Sauldre, France

[73] Assignee: Centre d'Automatismes et de Recherches Electroniques Centaure, Brinon sur Sauldre, France

[21] Appl. No.: 895,337

[22] Filed: Aug. 11, 1986

[30] Foreign Application Priority Data

Sep. 30, 1985 [FR] France ..... 85 14475

[51] Int. Cl.[5] ..... G09G 3/14

[52] U.S. Cl. ..... 340/762; 340/782

[58] Field of Search ..... 340/719, 784, 762, 782, 340/384 E; 357/23.11, 42; 307/264; 273/237; 367/139

[56] References Cited

U.S. PATENT DOCUMENTS

| | | | |
|---|---|---|---|
| 3,541,543 | 11/1970 | Crawford et al. | 340/719 |
| 4,014,013 | 3/1977 | McElvoy | 340/762 |
| 4,247,925 | 1/1981 | Meshi et al. | 273/237 |
| 4,426,766 | 1/1984 | Lee | 357/42 |
| 4,633,242 | 12/1986 | Sekiya | 340/719 |
| 4,656,469 | 4/1987 | Oliver et al. | 340/784 |
| 4,669,424 | 6/1987 | Bianco et al. | 367/139 |
| 4,682,162 | 7/1987 | Holloman | 340/719 |
| 4,689,504 | 8/1987 | Raghonathan et al. | 307/264 |
| 4,725,993 | 2/1988 | Owen et al. | 340/384 E |

*Primary Examiner*—Jeffery A. Brier
*Assistant Examiner*—Richard A. Hjerpe
*Attorney, Agent, or Firm*—Foley & Lardner, Schwartz, Jeffery, Schwaab, Mack, Blumenthal & Evans

[57] ABSTRACT

A light emitting diode display panel is provided for forming an electroluminescent panel. Light emitting diodes which are disposed in an array are driven directly by flip-flops forming a memory in accordance with high speed CMOS technology. The diodes are connected directly to the outputs of these memory devices and the current which flows through the diodes is determined by the supply voltage of the memories. The direct connection from the high speed CMOS memory devices to the LEDs eliminates the need for buffers to drive the LEDs.

15 Claims, 1 Drawing Sheet

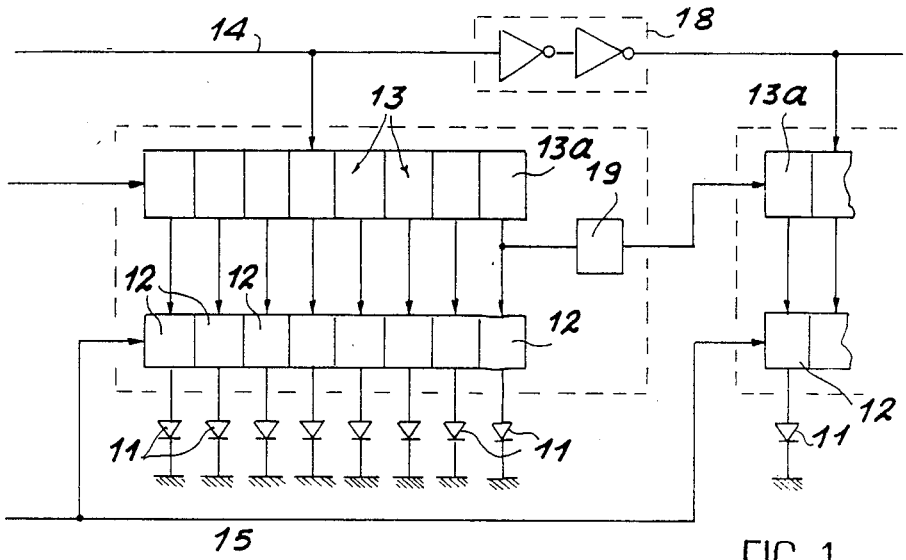
FIG. 1
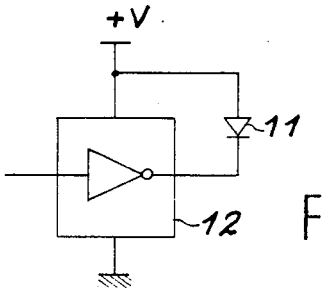
FIG. 3
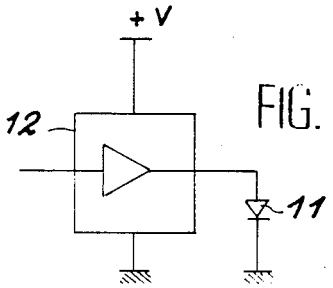
FIG. 2
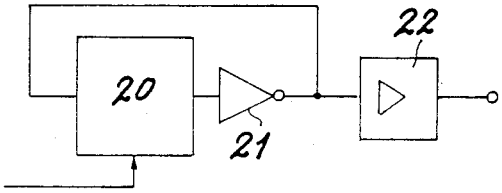
FIG. 4
FIG. 5
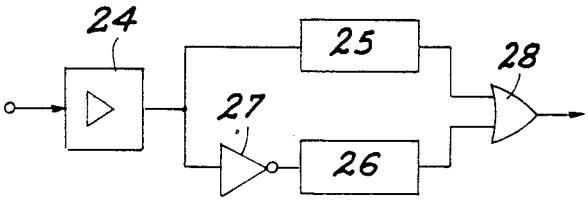

DIRECTLY DRIVEN LIGHT EMITTING DIODE ARRAY

BACKGROUND OF THE INVENTION

The invention relates to a display panel with light emitting diode array forming typically an electroluminescent display and it relates more particularly to such a panel both more economic and more luminous than similar systems, while allowing faster display.

A conventional electroluminescent display is formed of an array of light emitting diodes, a corresponding number of members (typically bistable flip flops) inserted between said diodes and a shift register in which flows the information representative of an image to be displayed. This information is delivered at the timing of a clock by a control unit associated with a programme memory. The control unit and the programme memory are generally situated in a case separate from the panel and connected to this latter by a strand of conducting wires. This arrangement is advantageous when the diode panel is intended to be placed outside and subjected to bad weather. In this case, the most fragile components contained in the control unit may be placed in a sheltered position and more readily accessible for modification or updating the messages to be reproduced. Up to now, it has been fairly difficult to adapt the characteristics of the memories to those of the light emitting diodes. Thus attempts have been made to supply the diodes through load resistors, but this type of circuit has the drawback of power consumption in the resistors which is not directly useful for the display. The cost price is moreover high, not only because of the number of resistors required but also because of the labour cost for wiring them. Attempts have been made to supply the light emitting diodes directly by the current delivered by the memories, But that generally results in causing said memories to work outside the characteristics provided by the constructor of these integrated circuits. Such a method of construction is, at the limit, conceivable for displaying moving messages, for the diodes are used only for a small part of the time. This becomes more difficult to contemplate for displaying fixed messages, particularly graphic images, where some diodes may be permanently lit for relatively long periods of time, whence much more unfavourable operating conditions for the memories which supply them.

SUMMARY OF THE INVENTION

The invention allows more particularly this problem to be overcome. The basic principle of the invention results from the search for a better matching between the integrated circuits available, forming the memories and the light emitting diodes usually used for such an application. By analysing the characteristics of recent integrated circuits of high speed CMOS technology, it has been discovered that the constructors of these integrated circuits designed for high speed digital computing applications, had been led to lowering the supply voltage while allowing a higher current, so that the circuits may be driven at a higher clock frequency. One of the features of the invention is to propose a new application for this type of component, for directly supplying a light emitting diode.

To this end, the invention relates then essentially to a light emitting diode array display panel, each diode being supplied through a memory, wherein the memories are formed using high speed CMOS technology, the diodes are directly connected to the outputs of the respective memories and the supply voltage for said memories is chosen for fixing the value of the current in said diodes.

Another problem resolved by the invention is related to the very structure of the display panels. It is a question of efficiently transmitting the high frequency clock to all the circuits despite the large dimensions of the diode array. In fact, it is not possible to provide a clock common to all the integrated circuits. The parasite capacities which would result therefrom would not allow the transfer of information at the chosen frequency, i.e. of the order of 2 Mhz. It is then necessary to provide at intervals means for amplifying or for regenerating the clock signal, which may desynchronize the different circuits of the shift register. In another aspect of the invention, means are provided so that the shift register operates correctly without the clock signal being really synchronized at all the points of the register.

To this end, the above defined display panel is also characterized in that the stages of the shift register are arranged in groups of stages adjacent each other, an amplifying and reshaping means is inserted in the clock connection between any two adjacent groups and a delay means is inserted between the data output and the data input of the same adjacent groups.

Another feature of the invention consists in supplying the display panel with a reduced frequency clock and to regenerate the high frequency clock in the display panel itself, whereby it is possible to use a larger length of conducting cable between the control unit and the high frequency clock properly speaking, and the display panel.

BRIEF DESCRIPTION OF THE DRAWINGS

The invention will be clearer from the following description, given solely by way of example with reference to the accompanying drawings in which:

FIG. 1 illustrates partially a general diagram of the assembly of memories and the shift register associated with the light emitting diodes;

FIG. 2 is a diagram of a possible connection between a light emitting diode and its memory;

FIG. 3 is a connection variant;

FIG. 4 shows the diagram of a clock frequency reducing circuit; and

FIG. 5 shows the diagram of a clock frequency multiplying circuit.

DESCRIPTION OF THE PREFERRED EMBODIMENT

There is shown in the drawings, a part of a display panel having light emitting diodes 11 connected respectively to memories 12 formed in accordance with high speed CMOS technology, today commercialized under the reference HCMOS by most semiconductor constructors. Each memory is formed of a bistable flip flop and, in accordance with the invention, the corresponding diode 11 is connected directly to its output, that is to say more particularly without series resistor. There exist two possibilities of connecting the diode with respect to the flip flop, either by using the channel N transistor, the diode being connected between the output of the memory and ground (FIG. 2), or by using the P channel transistor, the diode being connected this time to the supply terminal (FIG. 3).

Referring again to FIG. 1, it can be seen that the memories 12 are connected so as to be charged by the outputs of a series type shift register, that is to say with series data inputs and parallel outputs, these latter being connected to the loading inputs of the memories 12. The information progresses in the register at the timing of a high frequency clock, applied by a clock connection 14. The transfer of information from the inputs to the outputs of the memories 12 is controlled when the sequence of information corresponding to a complete image has reached the last stage of the shift register 13. At that time, a control signal is applied on a loading bus 15 common to all the memories 12. In practice, the system for driving the diode array 11 will be advantageously formed by a cascade mounting of a suitable number of integrated circuits of the 74 HC4094 B type incorporating both stages 13*a* of the shift register and a corresponding number (8 in the example) of memories 12 connected to the outputs of these register stages. The accessible outputs of said memories 12 are connected directly to light emitting diodes 11, respectively; according to the assembly of FIG. 2 or that of FIG. 3. The output of the last stage of the register of a given integrated circuit is connected to the input of the first stage of another integrated circuit of the same type situated nearby. The current from each flip flop forming memory 12 is sufficient for optimally supplying the light emitting diode, which requires typically a current of the order of 25 mA. In fact, this integrated circuit can be supplied at a lower voltage than the other MOS type circuits and this voltage may vary within fairly wide limits. Thus this feature is used for adjusting or determining the current flowing in the diodes, by choosing the supply voltage accordingly. Typically, with the type of integrated circuit mentioned above, the voltage is chosen at about 4 volts, so as to obtain a current of the order of 25 mA in each diode. For this current value, the voltage of the terminals of the diode is close to 1.8 V. The power dissipated in each memory is therefore of the order of 0.062 W. Since each integrated circuit contains 8 memories, the maximum power dissipated by said integrated circuit (corresponding to 8 illuminated diodes) is 0.5 W, which corresponds to the permissible power for this type of integrated circuit. If we admit a rate of use of the diodes of the order of 35%, the mean power dissipated by each circuit is therefore in fact only 0.174 W.

According to another important feature of the invention, the stages 13*a* of the shift register are arranged in groups of stages adjacent each other (that is to say topologically neighbours on the display panel) and an amplification and reshaping means 18 is inserted in the clock connection between any two such adjacent groups, whereas a delay means 19 is inserted between the data output and the data input of these same adjacent groups. Thus, the high frequency clock signal is always useful from one end to the other of the display panel, despite the parasite capacities distributed over the whole distance, thanks to means 18 disposed at intervals. The desynchronization which results therefrom is without consequence because of the delay provided simultaneously in the transfer of information, from group to group. The delay between two groups will have to be greater than the delay of the clock between these same groups. In practice, each amplifier may be formed by two cascade inverters, for example available in integrated circuits of the same category, bearing the reference 74 HCU 04. Delay means 19 are further available in each integrated circuit of type 74 HC 4094 B including the registers and the memories. In the example of FIG. 1, for the sake of simplification an amplifier 18 and a delay means 19 have been shown associated with each integrated circuit, that is for eight diodes. In fact, they may be much more "spaced", the number of stages of each group being able to be between 10 and 40 and preferably close to 30. Finally as mentioned above, the clock signal may be transmitted at a reduced frequency in the strand of conducting wires connecting together the display panel and its control unit including the high frequency clock generator, not shown. Thus, the device of FIG. 4 connected to the output of the high frequency clock generator, so at a distance from the panel, delivers a signal whose frequency is reduced by half. It is formed of a flip flop 20 relooped to its input by an inverter 21 whose output signal is amplified at 22 before being applied to the clock line. The device of FIG. 5 is a frequency multiplier designed for doubling the frequency of the signal which it receives. It is formed of an amplifier 24 distributing its output signal to two monostables 25, 26 mounted in parallel and phase shifted by an inverter 27. The outputs of the two monostables are connected to the two inputs of an OR gate 28 whose output restores the original frequency.

The system which has just been described allows successive images to be displayed at very high speed, up to 1000 images per second. These performances may be used for continuously displaying a fixed image comprising diodes lit at different light levels, obtained by rapid and successive lighting and extinction of these diodes. By way of example, for a minimum frequency of 20 images per second up to 50 different light levels may be obtained.

What is claimed is:

1. A light emitting diode array display comprising:

an array of light emitting diodes;

a voltage supply means;

a shift register receiving information from a control unit for images to be displayed on the display, the shift register shifting the information from a first stage to a last stage through intermediate stages;

high speed CMOS memories connected to the voltage supply means, the high speed CMOS memories having inputs connected to the stages of the shift register and outputs directly connected to diodes of the array, wherein a current in the diodes is directly dependent on a voltage supplied to the memories by the voltage supply means.

2. The light emitting diode array display recited in claim 1, wherein said memories are formed from integrated circuits of the HCMOS series.

3. The light emitting diode array display recited in claim 2, wherein the integrated circuits are of the 74HC4094B type.

4. The light emitting diode array display recited in claim 1, wherein the shift register is a serial in, parallel out shift register receiving the information in response to a clock signal and the memory inputs load information from the shift register stages in response to a common load signal.

5. The light emitting diode array display recited in claim 4, wherein said clock signal is generated at a distance from said display and is connected to the display by a connection of a certain length, and wherein said clock signal is applied to a frequency reducing circuit for generating a reduced frequency clock signal at said distance from said display, said reduced frequency clock signal being applied to a frequency multiplier at said display for regenerating a high frequency clock signal.

6. The light emitting diode array display recited in claim 4, wherein the stages of the shift register are arranged in adjacent groups such that a clock signal is applied to each group, each group having a data output stage and a data input stage, the data output stage of one group being connected to the data input stage of an adjacent group through a delay means for delaying the information being received, and wherein an amplification and reshaping means for amplifying and reshaping a clock signal is applied to the clock signal between any two adjacent groups.

7. The light emitting diode array display recited in claim 6, wherein the number of stages of each group is between 10 and 40.

8. The light emitting diode array display recited in claim 7 wherein the number of stages of each group is about 30.

9. A method of controlling a light emitting diode array display, the method comprising the steps of:

from a control unit receiving into a shift register information for images to be displayed;

shifting the information from a first stage of the shift register to a last stage through intermediate stages of the shift register;

supplying high speed CMOS memories with a supply voltage;

driving inputs of the high speed CMOS memories from the stages of the shift register and, with outputs of the high speed memories directly connected to diodes of the array, driving the diodes so that a current in the diodes is directly dependent on the voltage supplied to the memories.

10. The method of claim 9 wherein driving the light emitting diodes from high speed CMOS devices comprises driving the diodes directly from outputs of integrated circuits of the 74HC4094B type.

11. The method of claim 10 further comprising fixing the supply voltage at about 4 volts to supply a current of about 25 mA to each diode.

12. The method recited in claim 9, wherein the shift register is a serial in, parallel out shift register receiving the information in response to a clock signal and the memory inputs load information from the shift register stages in response to a common load signal.

13. The method of claim 12 further comprising generating the clock signal at a distance from the display, applying the clock signal to a frequency reducing circuit for generating a reduced frequency clock signal at said distance from the display and applying the reduced frequency clock signal to a frequency multiplier at the display and regenerating a high frequency clock signal.

14. The method of claim 12 further comprising:

arranging the shift register in adjacent groups of stages such that a clock signal is applied to each group, each group having a data output stage and a data input stage, the data output stage of one group being connected to the data input stage of an adjacent group through a delay means for delaying the information being received, and amplifying and reshaping the clock signal between any two adjacent groups of stages of the shift register.

15. The method of claim 14 wherein the delay means between the data output stage and data input stage of two adjacent groups delays information received by an amount longer than a corresponding delay experienced by the clock signal which is amplified and reshaped between the same two adjacent groups.

* * * * *